United States Patent [19]

Hidaka et al.

[11] Patent Number: 4,647,937

[45] Date of Patent: Mar. 3, 1987

[54] ANTENNA APPARATUS WITH TUNED LOOP

[75] Inventors: Kazutaka Hidaka; Kenji Suehiro, both of Yokohama, Japan

[73] Assignee: Tokyo Shibaura Denki Kabushiki Kaisha, Kawasaki, Japan

[21] Appl. No.: 846,195

[22] Filed: Mar. 31, 1986

Related U.S. Application Data

[63] Continuation of Ser. No. 382,660, May 27, 1982, abandoned.

[30] Foreign Application Priority Data

| | | | |
|---|---|---|---|
| Jun. 5, 1981 | [JP] | Japan | 56-86480 |
| Jun. 5, 1981 | [JP] | Japan | 56-86481 |
| Sep. 21, 1981 | [JP] | Japan | 56-147946 |

[51] Int. Cl.[4] ..... H01Q 7/00

[52] U.S. Cl. ..... 343/742; 343/743; 343/744

[58] Field of Search ..... 343/702, 741, 742, 743, 343/744; 455/188, 193, 272, 274, 275

[56] References Cited

U.S. PATENT DOCUMENTS

| | | | |
|---|---|---|---|
| 2,324,462 | 7/1943 | Leeds | 343/744 |
| 2,467,961 | 4/1949 | Caraway et al. | 343/744 |
| 2,467,962 | 4/1949 | Caraway et al. | 343/744 |
| 2,469,209 | 5/1949 | Scheldorf | 343/744 |
| 2,551,664 | 5/1951 | Galper | 343/742 |
| 2,842,765 | 7/1958 | Schmitt | 343/726 |
| 3,176,299 | 3/1965 | Caraway | 343/744 |
| 3,284,801 | 11/1966 | Bryant | 343/743 |
| 3,582,951 | 6/1971 | Altmayer | 343/744 |
| 3,588,905 | 6/1971 | Dunlavy, Jr. | 343/856 |
| 3,631,499 | 12/1971 | Turner | 343/701 |
| 3,641,576 | 2/1972 | Farbanish | 343/743 |
| 3,680,127 | 7/1972 | Richard | 343/708 |
| 3,956,751 | 5/1976 | Herman | 343/744 |
| 4,004,228 | 1/1977 | Mullett | 343/702 |
| 4,342,999 | 8/1982 | Woodward et al. | 343/702 |
| 4,518,965 | 5/1985 | Hidaka | 343/742 |

FOREIGN PATENT DOCUMENTS

| | | |
|---|---|---|
| 1769468 | 7/1958 | Fed. Rep. of Germany . |
| 973146 | 12/1959 | Fed. Rep. of Germany . |
| 2228043 | 6/1972 | Fed. Rep. of Germany . |
| 2310672 | 3/1973 | Fed. Rep. of Germany . |
| 8015231 | 6/1980 | Fed. Rep. of Germany . |
| 3039524 | 7/1981 | Fed. Rep. of Germany . |
| 1339640 | 9/1963 | France . |
| 54-41192 | 12/1979 | Japan . |
| 652716 | 5/1951 | United Kingdom . |
| 1307648 | 2/1973 | United Kingdom . |
| 1387679 | 3/1975 | United Kingdom . |
| 1480829 | 7/1977 | United Kingdom . |
| 1537750 | 11/1977 | United Kingdom . |
| 2039152 | 7/1980 | United Kingdom . |

OTHER PUBLICATIONS

*Antenna and Waves,* King et al., pp. x–xi and 437–447, MIT Press, 1969.

*Antenna Engineering Handbook,* Chapter 7, pp. xiii, 319–322 and 416–417, edited by the Institute of Electronics and Communication.

*Engineering of Japan,* 1980.

*Primary Examiner*—Eli Lieberman

*Attorney, Agent, or Firm*—Finnegan, Henderson, Farabow, Garrett & Dunner

[57] ABSTRACT

An antenna apparatus including a small loop antenna element fabricated by printed circuit method, a variable capacitor for matching the antenna element to broadcasting frequency and an amplifier for the received signal. The variable capacitor and the amplifier are mounted on a printed circuit board containing the loop antenna element and the variable capacitor is rotatably mounted on the board centrally of the loop antenna element. A second loop antenna element may be mounted either concentrically on the said side of the printed circuit board or on the other side of the board. A second variable capacitor cooperates with the second antenna element and a single manual element controls both capacitors.

7 Claims, 7 Drawing Figures

ANTENNA APPARATUS WITH TUNED LOOP

This application is a continuation, of application Ser. No. 382,660, filed May 27, 1982, now abandoned.

FIELD OF THE INVENTION

This invention relates to an antenna apparatus and more particularly, to a compact antenna apparatus.

BACKGROUND OF THE INVENTION

It has been hoped to obtain an antenna apparatus which is compact in size but has high gain.

Conventional antenna apparatus used for FM (frequency modulation) radio receivers, in the past, must be large in size for obtaining high gain. For example, dipole antennas for FM radio receivers ordinarily have lengths of around two meters. Therefore, such large size antenna apparatus is inconvenient for setting at a place near FM radio receivers in living areas. On the other hand, a conventional large size antenna apparatus located outdoors, such as on roofs, is inconvenient for matching frequencies to those of individually desired broadcasting stations.

SUMMARY OF THE INVENTION

It is, therefore, an object of the present invention to improve antenna apparatus so as to obtain both relatively small size and capacity for matching frequencies to those of individually desired broadcasting stations.

Another object of the present invention is to improve the ease of adjustment of operating frequencies of antenna apparatus.

A further object of the present invention is to obtain high gain in small size antenna apparatus.

According to the present invention, the antenna apparatus is provided with: (a) an insulating base plate, (b) a loop antenna element secured on the base plate, (c) capacitor means centrally located within the loop antenna element both for tuning the antenna element and for counteracting possible capacitance between the loop antenna element and an outside foreign object, and (d) means interconnecting the capacitor means and the loop antenna element to form a loop.

Additional objects and advantages of the present invention will become apparent to persons skilled in the art from a study of the following description of the accompanying drawings, in which:

DESCRIPTION OF THE PREFERRED EMBODIMENTS

Figure 1:
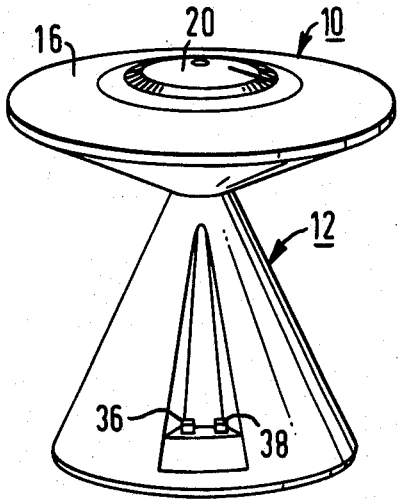
FIG. 1 is a perspective view of the antenna apparatus according to the present invention.

The present invention will be described in detail with reference to the accompanying drawings FIG. 1 to FIG. 7. Throughout the drawings like reference numerals and letters will be used to designate like or equivalent elements for the sake of simplicity of explanation.

Referring now to FIG. 1, there is shown an antenna apparatus of one embodiment, according to this invention. The antenna apparatus has a disc-shaped upper portion 10 and a conical lower portion 12 for supporting upper portion 10 on its smaller end.

Figure 3:
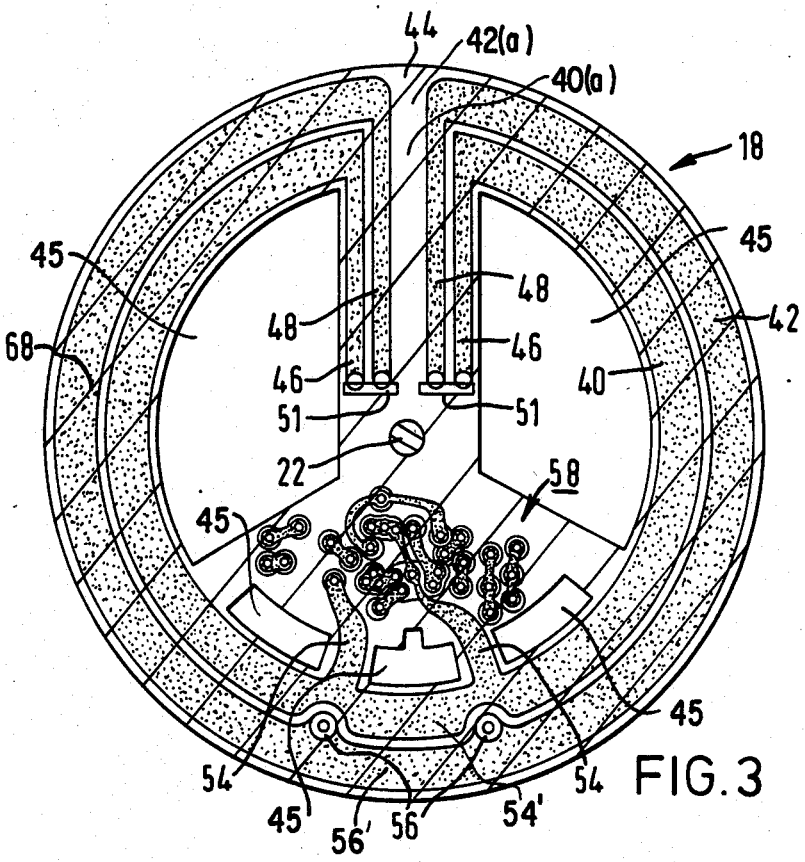
FIG. 3 is a plan view of one side of the circuit assembly shown in FIG. 2.
Figure 2:
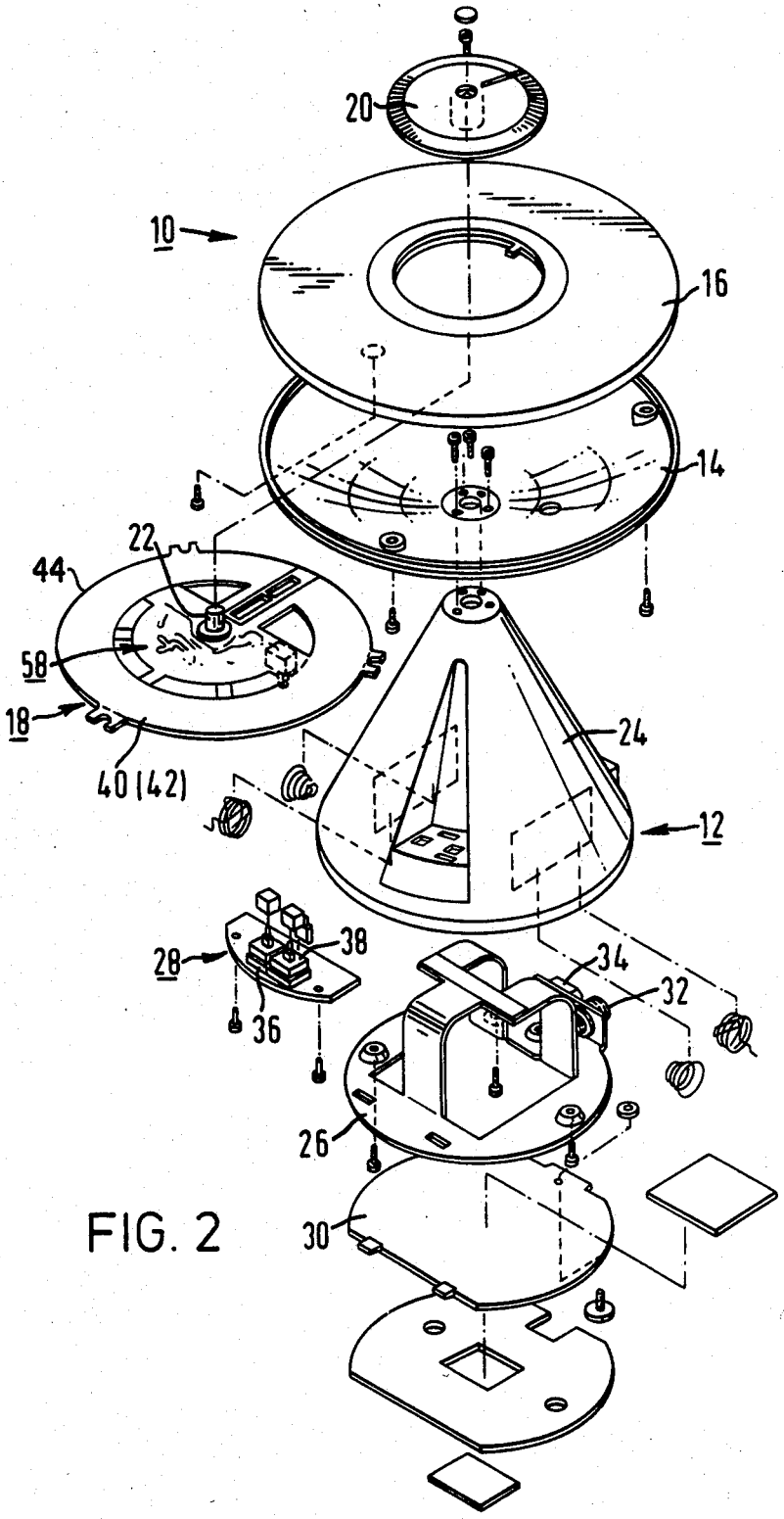
FIG. 2 is an exploded view of the antenna apparatus of FIG. 1.
Figure 4:
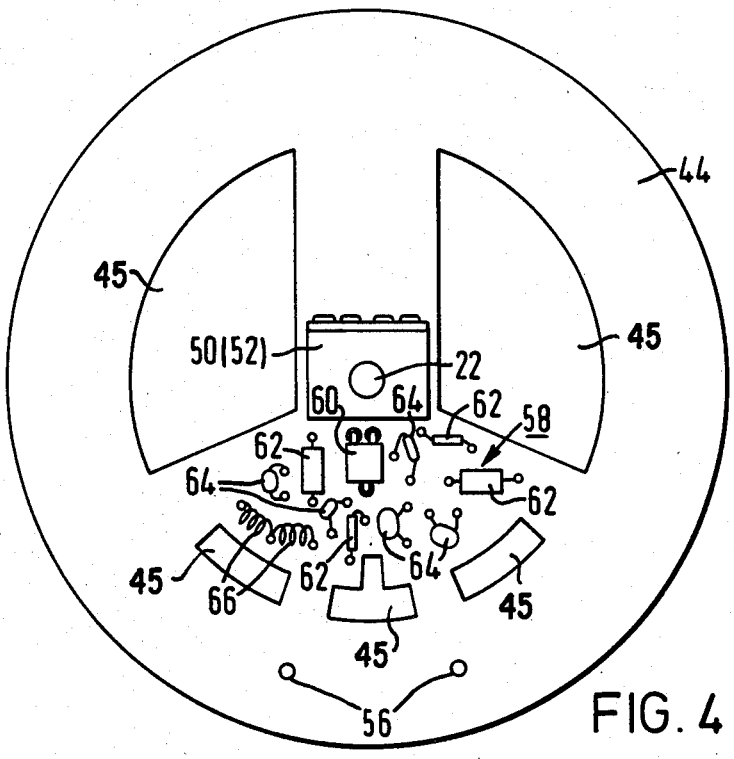
FIG. 4 is a plan view of other side of the circuit assembly of FIG. 3.

Details of the antenna apparatus as to both upper and lower portions are shown in FIGS. 2–4. Upper portion 10 has a main chassis 14, an annular cover 16, a circuit assembly 18 and a dial 20. Circuit assembly 18 is supported on chassis 14 and covered by cover 16. Dial 20 is located in the open center area of annular cover 16 and is connected by shaft 22 to variable capacitors 50 and 52 (FIG. 4) of circuit assembly 18. Chassis 14, cover 16 and dial 20 are made of dielectric materials, like plastics, and therefore do not shield circuit assembly 18 from broadcasting waves.

Lower portion 12, supporting upper portion 10, is composed primarily of conical case 24, holder 26, switch assembly 28 and bottom plate 30. Holder 26, located in case 24, contains signal output terminal 32, auxiliary source terminal 34 and batteries (not shown). Switch assembly 28, located in case 24, includes power switch 36 and antenna selector switch 38.

Figure 5:
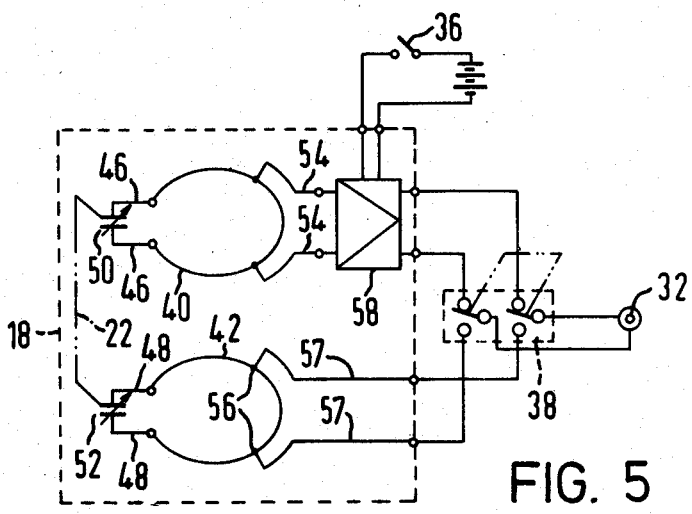
FIG. 5 is a circuit diagram for the circuit assembly of FIG. 2.

Referring now to FIGS. 3 and 4, there is shown in detail circuit assembly 18. In circuit assembly 18, two open-ended loop-shaped antenna elements 40 and 42 are fabricated on base plate 44 by any appropriate printed circuit method. The antenna elements 40 and 42 are arranged concentrically to one another and each includes a small open end portion, 40(*a*) and 42(*a*), respectively, as is known in the art. Two pairs of coupling wirings 46 and 48 are connected between respective open ends of antenna elements 40 and 42 and terminals 51 of variable capacitors 50 and 52 (shown in FIG. 4) respectively. Specifically, as shown in FIG. 5, variable capacitor 50 is connected across the open end of antenna element 40 to form a first closed loop and variable capacitor 52 is connected across the open end of antenna element 42 to form a second closed loop.

A pair of coupling wirings 54 is connected between antenna element 40 and amplifier section 58. The connecting points on antenna element 40 for coupling wirings 54 thereto are separated by a given distance to define a segment 54' of antenna element 40. The length of segment 54' is selected to permit maximum gain of antenna output to be fed out between the connecting points which define the ends of segment 54'. Coupling wirings 54 from antenna element 40 are connected to a two-port input of amplifier section 58 as shown in FIG. 5. Amplifier section 58 has a conventional RF (radio frequency) amplifier structure like one cited in the Jitsuyo Denshi-kairo Handbook Vol. 1, p. 199, FIGS. 3–51, published by CQ Publishing Co., on Sept. 30, 1979.

A pair of coupling terminals 56 on antenna element 42 defines a segment 56' of antenna element 42. Coupling terminals 56 are directly connected to one input of antenna selector switch 38 through lead wires 57 shown in FIG. 5. The other input of antenna selector switch 38 is connected to the output of amplifier section 58. The output of antenna selector switch 38 is connected to output terminal 32. Accordingly, selector switch 38 may be operated to connect either the output of amplifier section 58 or segment 56' of antenna element 42 to output terminal 32. In case of excessively strong broadcasting waves, segment 56' of antenna element 42 is selected for connection to output terminal 32.

Figure 6:
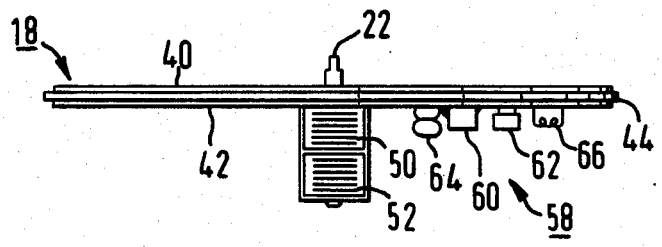
FIG. 6 is a side view of another embodiment of the circuit assembly of the invention.

As shown in FIGS. 3, 4 and 6, variable capacitors 50 and 52 and amplifier section 58 are all located on base plate 44 within the loops of antenna elements 40 and 42. In FIG. 4, capacitors 50 and 52 are both rotatably mounted on base plate 44 on the side opposite to the side on which antenna elements 40 and 42, are mounted. Capacitors 50 and 52 are further shown in FIGS. 4 and 6 to have a common capacitance control shaft 22. Shaft 22 penetrates base plate 44 at its center portion and the end of the shaft is coupled to rotatable dial 20 (shown in FIG. 2).

As is further shown in FIGS. 3, 4 and 6, amplifier section 58 includes a plurality of circuit parts such as transistor 60, resistors 62, capacitors 64 and coils 66 which are interconnected by the printed circuit patterns of amplifier section 58 shown on the side of base plate 44 which is illustrated in FIG. 3.

Parts 45 of the base plate 44 which are unnecessary for antenna elements 40 and 42, amplifier section 58 and the like, are cut out for increasing the electrical insulation between antenna elements 40 and 42 and amplifier section 58.

The front side of base plate 44 may be covered by solder-resist coating 68 (shown by hatching on FIG. 3) except for the soldering points of the circuit parts. Solder-resist coating 68 also increases the electrical insulation between antenna elements 40 and 42 and amplifier section 58, and further prevents changes in the electrical characteristics of antenna elements 40 and 42 due to solder attaching to the antenna elements.

Referring now particularly to FIG. 6, there is shown a side view of the circuit assembly 18 of another embodiment of the present invention. In FIG. 6, two antenna elements 40 and 42 are arranged on opposite sides of base plate 44. Otherwise the elements are the same as the first embodiment shown in FIGS. 3 and 4. In this embodiment, it is easy to make the electrical characteristics of both antenna elements 40 and 42 have the same conditions.

Figure 7:
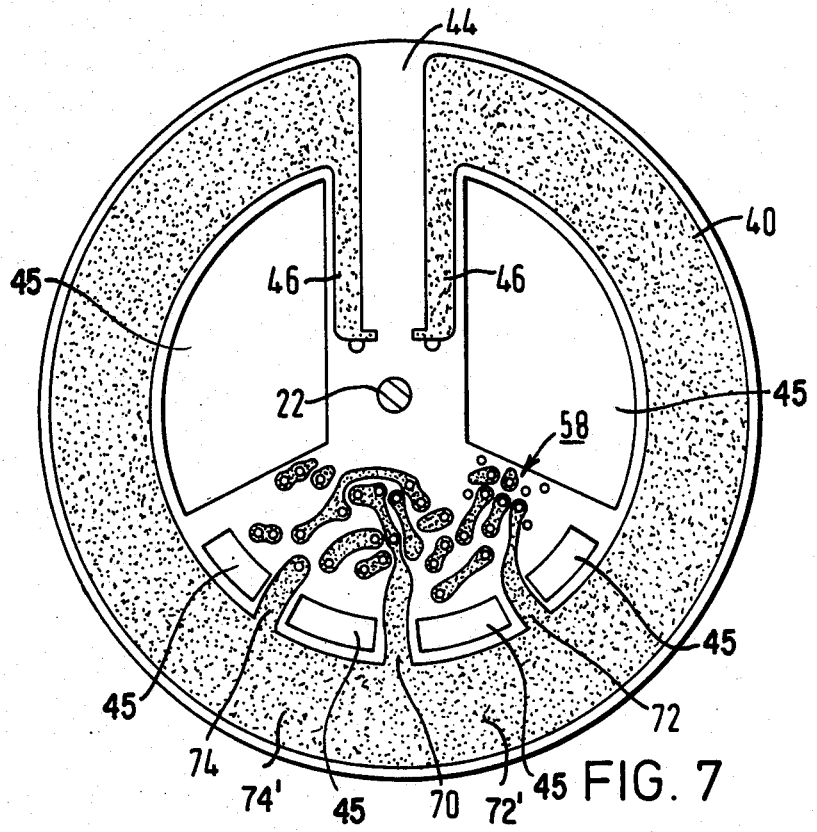
FIG. 7 is a plan view of further embodiment of the circuit assembly of the invention.

Referring now to FIG. 7, there is shown a plan view of the circuit assembly 18 of a further embodiment of the present invention. In the embodiment of FIG. 7, a common coupling wire 70 and two independent coupling wirings 72, 74 give flexibility of use to the single antenna element 40. The common coupling wiring 70 is connected between an intermediate point of loop antenna element 40 and ground (not shown). Independent coupling wiring 72, interconnects a first segment 72' of antenna element 40 across the two-port input of amplifier section 58. Independent coupling wiring 74 couples second segment 74' of antenna element 40 to antenna selector 38. Segments 72' and 74' are juxtapositioned to one another and both share the intermediate point of loop antenna element 40 where coupling wire 70 is connected. According to the embodiment of FIG. 7, either a non-amplified output from coupling wire 74 or an amplified output from amplifier section 58 may be obtained in spite of the fact that the antenna apparatus has only a single loop antenna element 40.

What is claimed is:

1. An antenna apparatus comprising:

a. an insulating base plate;

b. an open-ended, single loop antenna element secured to said base plate;

c. a variable capacitor means, secured to said base plate within said loop antenna element and connected to the open end of said loop antenna element to form a completed loop, for tuning said loop antenna element and for counteracting possible capacitance between said loop antenna element and an outside foreign object;

d. an amplifier secured to said base plate within said loop antenna element, said amplifier having an output and a two-port input connected across a first segment of said loop antenna element remote from eaid open end thereof;

e. a signal terminal; and f. switch means for selectively connecting either said output of said amplifier or a second segment of said loop antenna element to said signal terminal.

2. An antenna apparatus as recited in claim 1 wherein said first and second segments of said loop antenna element are contiguous to one another.

3. An antenna apparatus comprising:

a. an insulating base plate;

b. first and second open-ended, single loop antenna elements secured to said base plate;

c. first and second variable capacitor means, secured to said base plate within said first and second loop antenna elements with said first capacitor means connected to the open end of said first loop antenna element to form a first completed loop, and with said second capacitor means connected to the open end of said second loop antenna element to form a second completed loop, for tuning said first and second loop antenna elements, respectively, and for counteracting possible capacitance between said first and second loop elements and an outside foreign object;

d. an amplifier secured to said base plate within said first and second loop antenna elements, said amplifier having an output and a two-port input, said two-port input connected across a segment of said first loop antenna element remote from said open end thereof;

e. a signal terminal; and f. switch means for selectively connecting either said output of said amplifier or a segment of said second loop antenna element to said signal terminal.

4. An antenna apparatus as recited in claim 3 wherein said first and second loop antenna elements are concentrically arranged on the same side of said base plate.

5. An antenna apparatus as recited in claim 3 wherein said first and second loop antenna elements are arranged on opposite sides of said base plate.

6. An antenna apparatus as recited in any one of claims 3, 4 or 5, wherein both said first and second capacitor means include variable capacitors with a common capacitance control.

7. An antenna apparatus as recited in any one of claims 1, 2, 3 and 4 further comprising openings in said base plate for increasing insulation between a loop antenna element and said amplifier.

* * * * *